US008783292B2

(12) United States Patent
Hoffman et al.

(10) Patent No.: US 8,783,292 B2
(45) Date of Patent: Jul. 22, 2014

(54) OIL-LESS PRESSURE RELIEF VALVES

(75) Inventors: Karl K. Hoffman, Arlington Heights, IL (US); Keith P. Hoffman, Rolling Meadows, IL (US); Robert C. Larsen, Bartlett, IL (US); Douglas A. Wielunski, Bartlett, IL (US)

(73) Assignee: Plitek, L.L.C., Des Plaines, IL (US)

( * ) Notice: Subject to any disclaimer, the term of this patent is extended or adjusted under 35 U.S.C. 154(b) by 0 days.

(21) Appl. No.: 13/199,486

(22) Filed: Aug. 31, 2011

(65) Prior Publication Data

US 2013/0048635 A1 Feb. 28, 2013

(51) Int. Cl.

| | |
|---|---|
| ***F16K 15/14*** | (2006.01) |
| ***B65D 33/01*** | (2006.01) |
| ***B65D 77/22*** | (2006.01) |

(52) U.S. Cl.

CPC ..... *B65D 77/225* (2013.01)
USPC ..... 137/851; 210/499; 137/550; 383/100

(58) Field of Classification Search

USPC ..... 137/246, 844, 859, 544, 550, 800, 843, 137/851; 383/100; 210/499
See application file for complete search history.

(56) References Cited

U.S. PATENT DOCUMENTS

| | | | | |
|---|---|---|---|---|
| 2,927,722 | A * | 3/1960 | Metzger | 383/94 |
| 2,946,502 | A * | 7/1960 | Metzger | 383/94 |
| 3,595,467 | A | 7/1971 | Goglio | |
| 3,799,427 | A | 3/1974 | Goglio | |
| 4,000,846 | A | 1/1977 | Gilbert | |
| 4,122,993 | A | 10/1978 | Glass | |
| 4,134,535 | A | 1/1979 | Barthels et al. | |
| 4,206,870 | A | 6/1980 | DeVries | |
| 4,420,015 | A | 12/1983 | Blaser | |
| 4,444,219 | A | 4/1984 | Hollenstein | |
| 4,576,285 | A | 3/1986 | Goglio | |

(Continued)

FOREIGN PATENT DOCUMENTS

| | | | |
|---|---|---|---|
| DE | 3312887 | A1 | 10/1984 |
| EP | 0024310 | A1 | 7/1980 |

(Continued)

OTHER PUBLICATIONS

Excerpt from PackTV Web TV Channel for Packaging. "Avery Dennison Launches Flexis Air Pre-Oiled Valve for Coffee Packs." <www.packtv.co.uk/2011/11/avery-dennison-launches-flexis-air-pre-oiled-valve-for-coffee . . . > 4 pages.

(Continued)

*Primary Examiner* — John Rivell
*Assistant Examiner* — Angelisa Hicks
(74) *Attorney, Agent, or Firm* — Jansson Munger McKinley & Shape Ltd.

(57) ABSTRACT

A self contained one-way pressure relief valve for application to product packaging that does not require the addition of a sealing lubricant. Atop a base with an opening extending through the base is an adhesive-like material layer, and a dry strap of a silicone or other release film coated membrane, all of which are of gas impervious materials. The release film coated material layer covers the opening with the release film in contact with the adhesive-like material creating a surface attraction between the release film and the adhesive-like material. An intermediate layer of gas impervious material with an opening extending through such layer may be provided. A gas pervious filter material layer may be provided to block passage of fine particulates or liquid.

25 Claims, 3 Drawing Sheets

(56) References Cited

U.S. PATENT DOCUMENTS

| | | | | |
|---|---|---|---|---|
| 4,653,661 | A | 3/1987 | Buchner et al. | |
| 4,705,174 | A | 11/1987 | Goglio | |
| 4,890,637 | A | 1/1990 | Lamparter | |
| 4,971,218 | A | 11/1990 | Buchner et al. | |
| 5,263,777 | A | 11/1993 | Domke | |
| 5,326,176 | A | 7/1994 | Domke | |
| 5,427,839 | A | 6/1995 | Buchner et al. | |
| 5,445,870 | A | 8/1995 | Buchner et al. | |
| 5,515,994 | A | 5/1996 | Goglio | |
| 5,584,409 | A | 12/1996 | Chemberlen | |
| 5,727,881 | A | 3/1998 | Domke | |
| 5,782,266 | A * | 7/1998 | Domke | 137/551 |
| 5,989,608 | A | 11/1999 | Mizuno | |
| 6,070,728 | A | 6/2000 | Overby et al. | |
| 6,254,908 | B1 | 7/2001 | Winters | |
| 6,468,332 | B2 | 10/2002 | Goglio et al. | |
| 6,516,482 | B2 * | 2/2003 | Karafa et al. | 5/733 |
| 6,662,827 | B1 | 12/2003 | Clougherty et al. | |
| 6,663,284 | B2 | 12/2003 | Buckingham et al. | |
| 7,074,443 | B2 | 7/2006 | Thomas et al. | |
| 7,178,550 | B2 | 2/2007 | Stotkiewitz et al. | |
| 7,178,555 | B2 | 2/2007 | Engel et al. | |
| 7,243,683 | B2 | 7/2007 | Stotkiewitz et al. | |
| 7,244,223 | B2 | 7/2007 | Hartman et al. | |
| 7,328,543 | B2 | 2/2008 | Hoffman et al. | |
| 7,399,263 | B2 | 7/2008 | Hartman et al. | |
| 7,472,524 | B2 | 1/2009 | Hoffman et al. | |
| 7,490,623 | B2 | 2/2009 | Rypstra | |
| 7,611,557 | B2 | 11/2009 | Hoffman | |
| 7,637,283 | B2 | 12/2009 | Hoffman | |
| 7,922,026 | B2 | 4/2011 | Westphal | |
| 7,967,509 | B2 | 6/2011 | Turvey et al. | |
| 8,038,023 | B2 | 10/2011 | Moore et al. | |
| 8,082,644 | B2 | 12/2011 | Hoffman et al. | |
| 8,112,971 | B2 | 2/2012 | Newrones et al. | |
| 2004/0079419 | A1 * | 4/2004 | Taylor et al. | 137/550 |
| 2008/0041663 | A1 | 2/2008 | Hoffman et al. | |
| 2009/0145841 | A1 | 6/2009 | Arai | |
| 2009/0169693 | A1 * | 7/2009 | Hoffman | 426/395 |
| 2011/0108752 | A1 | 5/2011 | Morin | |
| 2011/0284536 | A1 | 11/2011 | Walters | |
| 2012/0243807 | A1 | 9/2012 | Pascoe | |
| 2012/0247346 | A1 | 10/2012 | Hoffman et al. | |
| 2012/0281933 | A1 | 11/2012 | Beer | |
| 2013/0048125 | A1 | 2/2013 | Hoffman et al. | |

FOREIGN PATENT DOCUMENTS

| | | | |
|---|---|---|---|
| EP | 1481911 | A1 | 1/2004 |
| EP | 1538107 | A2 | 8/2005 |
| WO | WO8304081 | A1 | 11/1983 |
| WO | WO2007113097 | A1 | 10/2007 |
| WO | WO2009142987 | A1 | 11/2009 |
| WO | WO2010020453 | A1 | 2/2010 |
| WO | WO2011056709 | A1 | 5/2011 |
| WO | WO2011091924 | A1 | 8/2011 |

OTHER PUBLICATIONS

Robert Bosch GmbH. "CVA 2000/3000 V45 Valve Applicators for the "aromafin" V45 Exterior Aroma Protection Valves." 4 pages. Date: Undated.

Robert Bosch GmbH. "Bosch aroma protection valves." 16 pages. Date: Undated.

Plitek Asia Limited. "Pli-Valv Product Selection Guide." 1 page. Date: Apr. 2005.

Plitek, LLC. "PV-15 One-Way Degassing Valve Product Specification." 1 page. Date: Oct. 2007.

Plitek, LLC. "PV-28 One-Way Degassing Valve Product Specification." 1 page. Date: Oct. 2007.

Plitek, LLC. "PV-41 One-Way Degassing Valve Product Specification." 1 page. Date: Oct. 2007.

Plitek, LLC. "PVA-120 Valve Applicator Product Specification." 1 page. Date: Oct. 2007.

Plitek, LLC. "Pli-Valv Package Degassing System PV-28." <www.plitek.com/products/pv28.asp> 1 page. Date: Jan. 30, 2008.

Plitek, LLC. "Pli-Valv Package Degassing System PV-41." <www.plitek.com/products/pv41.asp> 1 page. Date: Jan. 30, 2008.

* cited by examiner

OIL-LESS PRESSURE RELIEF VALVES

BACKGROUND OF THE INVENTION

1. Field of the Invention

This invention relates generally to one-way pressure relief valves that are applied to packaging for products, such as coffee, and more particularly to improved pressure relief valves that do not require a lubricant such as oil.

2. Background Art

Engel et al. U.S. Pat. No. 7,178,555 issued Feb. 20, 2007 discloses a one-way pressure relief valve attachable to product packaging to vent pressurized gases from the packaging. One-way pressure relief valves, such as the PLITEK PLIVALV PV-28 pressure relief valves, are applied to packaging for products, such as coffee, to allow unwanted gases to vent from the packaging while sealing out atmospheric gases. Such valves may vary in material and construction depending on the packaging application. They may be plastic or foil, and are generally self-adhering, thin, low profile designs supplied on a non-tearing polyester or paper liner. The valves are generally attached to the customer packaging with a heat sealed or pressure sensitive adhesive. An adhesive on the back side of the valves may initially mount them on the liner, until the valves are removed immediately prior to the application to the packaging, and then provides for attaching the valves to the packaging. In operation on the packaging, the valves open at a target pressure and then close at a lower target pressure, the values of which are dependent on the packaging application, after pressure inside the packaging drops. The valves vent unwanted gases and seal out atmospheric gases from rigid or flexible packaging or other enclosures. One advantage of such valves is that they allow a product such as coffee to be packed immediately after roasting and grinding to preserve freshness. Such one-way pressure relief valves allow a product such as coffee to degas during packaging and shipping, while reducing oxidation of the product. Use of such valves permits elimination of a bulk degassing process of the product prior to packaging. This not only speeds the overall process, saving time and money, and space, but also reduces exposure of the product to oxidation. Thus the product, such as coffee, is provided to consumers at a greater level of freshness and quality.

While not expressly disclosed in prior art such as Engel et al. U.S. Pat. No. 7,178,555 a sealing lubricant such as a silicone or graphite impregnated oil has to be injected between the membrane layers of the valve structure to ensure true one way functionality. Such required injection of a sealing lubricant is normally done just prior to applying the valve to the packaging. The dry strap membrane of such prior art valves is permitted to flex away from an opening to vent unwanted gases upon the inside of the packaging reaching the application determined opening pressure, and then when the pressure drops to the application determined closing pressure, the dry strap in cooperation with the sealing lubricant applied during the process of affixing the valve to the packaging, flexes back toward the opening to provide the one way valve function to prevent atmospheric gases from entering the packaging.

An example of such an application of lubricant is disclosed in Hoffman et al. U.S. Pat. No. 7,472,524 issued Jan. 6, 2009. Without such a sealing lubricant such prior art valves, while permitting gases to vent, would not properly close and would allow undesired atmospheric gases, including oxygen, into the packaging. The step of lubricating the valves adds time, cost and another factor to control in the process of applying the valves. After the injection of silicone, graphite impregnated oil, or some other sealing lubricant, the pressure relief valve is then attached to the packaging. While the oiled valve is often attached to the outside of the packaging, there may be instances in which it is desirable to put the valve inside with the product. Accordingly, there is a need for a one-way pressure relief valve that does not require the addition of a lubricant.

There also remains a need for a pressure relief valve that is protected from becoming fouled by fine particulate, including the product it is intended to keep at its highest quality.

It would also be desirable for certain products, and/or for packaging intended to be used in certain environments, to have a pressure relief valve in which liquid is prevented from penetrating the valve seal layer.

SUMMARY OF THE INVENTION

The present invention is concerned with providing a self contained one-way pressure relief valve for application to product packaging without requiring the addition of a sealing lubricant. A gas impervious base layer having a top and bottom has an opening extending through the base layer from top to bottom. Atop the base layer and covering the opening extending through the base layer is a gas impervious adhesive-like material layer. A gas impervious silicone or other release film coated membrane covers the opening extending through the base layer with the release film in contact with the adhesive-like material creating a surface attraction between the release film and the adhesive-like material.

The release film coated membrane covering the opening extending through the base layer may not extend to the edges of the adhesive-like material layer in one direction, and it may not extend to the edges of the base layer in one direction.

A gas impervious adhesive layer having a thickness on the bottom of the base may attach the base to the packaging with an opening, generally aligned with the opening extending through the base layer, extending through the thickness of the adhesive layer.

A gas impervious cover layer and a gas impervious adhesive layer between the cover layer and the silicone or other release film coated membrane, opposite the silicone or other release film may be provided.

The self contained one-way pressure relief valve may also have a gas impervious intermediate layer having a top and bottom between the adhesive-like material layer and the base with an opening extending through the intermediate layer from top to bottom and generally aligned with the opening in the base and the opening in the adhesive-like material layer, a fitter material layer between the openings of the intermediate layer and the base, a gas impervious layer of adhesive between the intermediate layer and the fitter material layer, and an opening extending through the layer of adhesive between the intermediate layer and the filter material layer, and generally aligned with the openings of the adhesive-like material layer, the intermediate layer, and the base.

The opening in the base may be larger than the openings in the intermediate layer and the layer of adhesive between the intermediate layer and the filter material layer, the filter material layer may be secured around its periphery by a portion of the layer of adhesive between the intermediate layer and the filter material layer, and the filter material layer maybe recessed in the opening in the base.

A plurality of openings of a size to prevent the passage of the product into the openings of the intermediate layer and the base may be included in the filter material layer.

A gas impervious layer of adhesive may be included between the filter material layer and the base with an opening extending through the layer of adhesive between the filter material layer and the base, and generally aligned with the openings of the adhesive-like material layer, the intermediate layer, the layer of adhesive between the intermediate layer and the filter material layer, and the base.

The filter material layer may include a plurality of openings of a size to prevent the passage of the product into the openings of the intermediate layer and the base in the area of the generally aligned openings extending through the adhesive-like material layer, the intermediate layer, the layer of adhesive between the intermediate layer and the fitter material layer, the layer of adhesive between the filter material layer and the base, and the base.

The filter material layer may prevent the passage of liquid while permitting the escape of gas, and may be an expanded polytetrafluoroethelene material, a liquid proof breathable fabric, a hydrophobic material, or an oleophobic material.

The present invention is also concerned with providing a pressure relief valve for application to product packaging having a gas impervious base layer having a top and bottom, an opening extending through the base layer from top to bottom, a gas impervious layer atop the base layer and covering the opening extending through the base layer, a gas impervious intermediate layer having a top and bottom between the layer atop the base layer and the base, an opening extending through the intermediate layer from top to bottom and generally aligned with the opening in the base and the opening in the layer atop the base layer, a filter material layer between the openings of the intermediate layer and the base, a gas impervious layer of adhesive between the intermediate layer and the filter material layer, and an opening extending through the layer of adhesive between the intermediate layer and the filter material layer, and generally aligned with the openings of the layer atop the base layer, the intermediate layer, and the base.

The opening in the base may be larger than the openings in the intermediate layer and the layer of adhesive between the intermediate layer and the filter material layer; the filter material layer may be secured around its periphery by a portion of the layer of adhesive between the intermediate layer and the filter material layer; and the filter material layer may recessed in the opening in the base.

A plurality of openings of a size to prevent the passage of the product into the openings of the intermediate layer and the base may be included in the filter material layer.

A gas impervious layer of adhesive may be included between the filter material layer and the base with an opening extending through the layer of adhesive between the filter material layer and the base, and generally aligned with the openings of the layer atop the base, the intermediate layer, the layer of adhesive between the intermediate layer and the filter material layer, and the base.

The filter material layer may include a plurality of openings of a size to prevent the passage of the product into the openings of the intermediate layer and the base in the area of the generally aligned openings extending through the layer atop the base, the intermediate layer, the layer of adhesive between the intermediate layer and the fitter material layer, the layer of adhesive between the filter material layer and the base, and the base.

The filter material layer may prevent the passage of liquid while permitting the escape of gas.

BRIEF DESCRIPTION OF THE DRAWINGS

For a better understanding of the present invention, reference may be had to the accompanying drawings in which.

DETAILED DESCRIPTION

Figure 1:
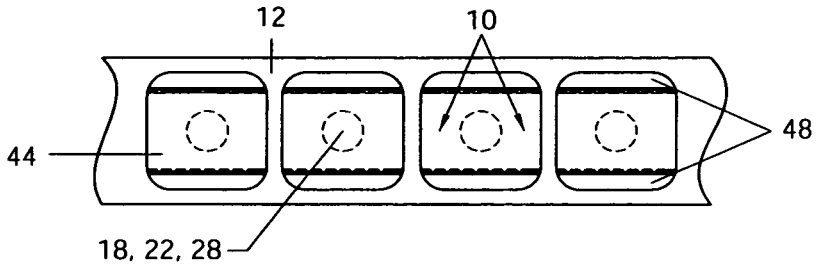
FIG. 1 is a top plan, reduced scale view of a fragment of a liner carrying a series of four exemplary pressure relief valves of the present invention.

The present invention relates to an improved one-way pressure relief valve for application to product packaging in which gases need to be vented from the packaging and atmospheric gases need to be prevented from entering back into the packaging through the valve, without requiring a lubricant to seal the valve. An exemplary series of four pressure relief valves 10 embodying the present invention is shown in FIG. 1 mounted on a fragment of a liner 12 for removal and attachment to product packaging. Liner 12 carries pressure relief valves 10 until the valves are removed during the process of attaching the valves to packaging as in Hoffman et al. U.S. Pat. No. 7,472,524 issued Jan. 6, 2009, but without the need for the step of injecting a lubricant such as by application of a vacuum to separate layers of the valve to provide for dispersal of a lubricant sprayed, or preferably atomized, into openings in the valve. The valves, the size of which is dependent on the packaging application, are conveniently spaced apart at regular intervals along liner 12, as for example, at a one inch pitch between centers, although the repeat spacing is also dependent on the packaging application. For use in packaging of a product such as coffee, an opening pressure less than 0.4 psig and a closing pressure greater than 0.008 psig. may be desirable for the valves.

Figure 2:
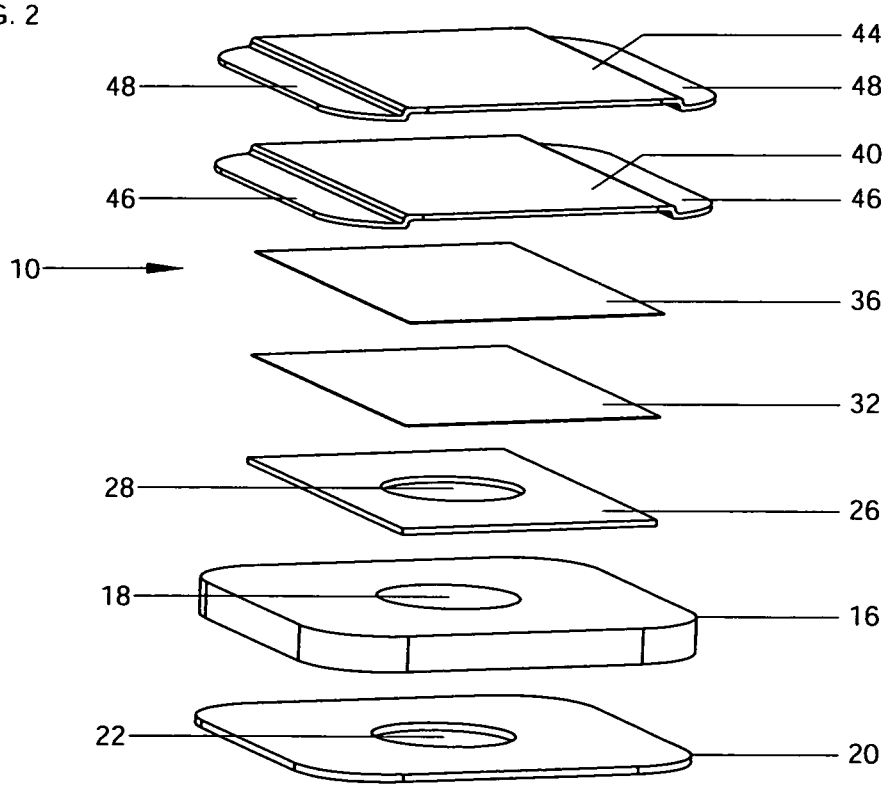
FIG. 2 is an exploded perspective view of an embodiment of a pressure relief valve embodying the present invention.

As illustrated in the exploded perspective view of FIG. 2, pressure relief valve 10, has a gas impervious bottom layer or base membrane 16 of polyethylene terephthalate ("PET") or other suitable plastic, approximately 0.25 to 50 mils in thickness. The overall material selection and construction of the valve is dependent not only on the product being packaged, but also on the nature of the packaging itself, particularly its flexibility or rigidity. The material and particularly the thickness of base membrane 16 are determined by those skilled in the art to overcome the bending force of the packaging. A hole or opening 18, which is best shown in FIG. 2, is generally centrally disposed within the perimeter of base membrane 16 and extends through the thickness of base membrane 16. To mount base membrane 16 on liner 12 for later removal from the liner and attachment to packaging, an adhesive layer 20 of approximately 0.25 to 15 mils in thickness is applied. Adhesive layer 20, which is also gas impervious, is also provided with a hole or opening 22 conveniently aligned with opening 18 in base membrane 16. A corresponding hole or opening through liner 12 is not needed for the valves of the present invention, but may result from the manufacturing process for the valves.

Positioned atop base membrane 16, covering opening 18, is a gas impervious layer 26 of an adhesive-like material, generally referred to as no tack, ultra low tack, cling film, self wetting, removable adhesive, or cohesive substrate of approximately 0.25 to 15 mils thickness. As illustrated in FIG. 2, a hole or opening 28 extending through the adhesive-like material layer 26 is also conveniently generally aligned with openings 18 and 22. A gas impervious silicone, or other dry release film, layer 32 coats a PET or other plastic gas impervious membrane 36, approximately 0.25 to 15 mils in thickness. The release coated membrane covers openings 28, 22, and 18, with release film layer 32 in contact with adhesive-like material layer 26 creating a surface attraction between release film layer 32 and adhesive-like material layer 26. As is best illustrated in FIG. 2, each of the layers 26, 32 and 36, extends generally the length of pressure relief valve 10, but is narrower than the width of pressure relief valve 10.

Over the top of membrane 36 and the side edges of the top surface of base membrane 16 is a gas impervious pressure sensitive adhesive layer 40 which is approximately 0.25 to 15 mils thick. A gas impervious PET or other plastic top or cover membrane 44, approximately 0.25 to 15 mils thick, covers the pressure sensitive adhesive layer 40. The adhesive of layer 40 conveniently has more adhesive, or peel, strength than adhesive layer 20 so the force of adhesion between pressure relief valve 10 and liner 12 will be less than the force of adhesion between the parts or layers of the pressure relief valve so that a pressure relief valve 10 may be removed from liner 12 without taking the valve apart.

As illustrated in FIG. 2, while all of the layers are generally coextensive in one direction, they are not in the transverse direction. More particularly, adhesive-like material layer 26, release film layer 32, and membrane 36 are not as wide in the transverse direction as base membrane 16, pressure sensitive adhesive layer 40, and membrane 44, and do not extend to the edges of base membrane 16, pressure sensitive adhesive layer 40, and membrane 44. This results in what appears in FIG. 2, to be lowered shoulders 46 and 48 along the edges of adhesive layer 40, and membrane 44, respectively. This helps prevent any sideways leakage, particularly of air into the packaging, which would be detrimental to the proper functioning of the valve. To prevent any flexing away below adhesive-like material layer 26, which could allow air into the packaging, materials of a thickness and flexibility appropriate to fit the packaging are used for base membrane 16 and adhesive layer 20.

Adhesive-like material layer 26 and release film layer 32 may be of the same size. However, a lower opening pressure is required and faster closing results when release film layer 32 is narrower than the layer of adhesive-like material layer 26. This creates a line of surface contact which allows the surface energies to bond together faster than if there were no line of surface contact when closing. When opening, the narrower dry release layer 32 creates a border for the escaping gas to follow, so the valve opens at a lower pressure.

Openings 18, 22 and 28 are illustrated in this embodiment as circular. However, they may have a different configuration, such as oval. The geometry of the openings, especially opening 18 in base membrane 16 has a direct correlation to opening pressure. The larger the perimeter of the opening the lower the opening pressure can be.

In operation, dry release film 32 coated membrane 36 is separated from adhesive-like material layer 26 by the build up of the target opening pressure inside the packaging to permit venting of the unwanted gases into the atmosphere. Membrane 36, pressure sensitive adhesive layer 40, and membrane 44 all flex upwardly together under the force of the target opening pressure to allow the gas to escape from the packaging. The upward flexing movement is generally parallel, and not transverse, to shoulders 46 and 48. After the gases are vented, and the pressure inside the packaging drops down to the target closing pressure, the attraction of the release film to the ultra low tack adhesive reseals the valve to provide one-way functionality and prevent the entry of oxygen and other atmospheric gases.

Figure 3:
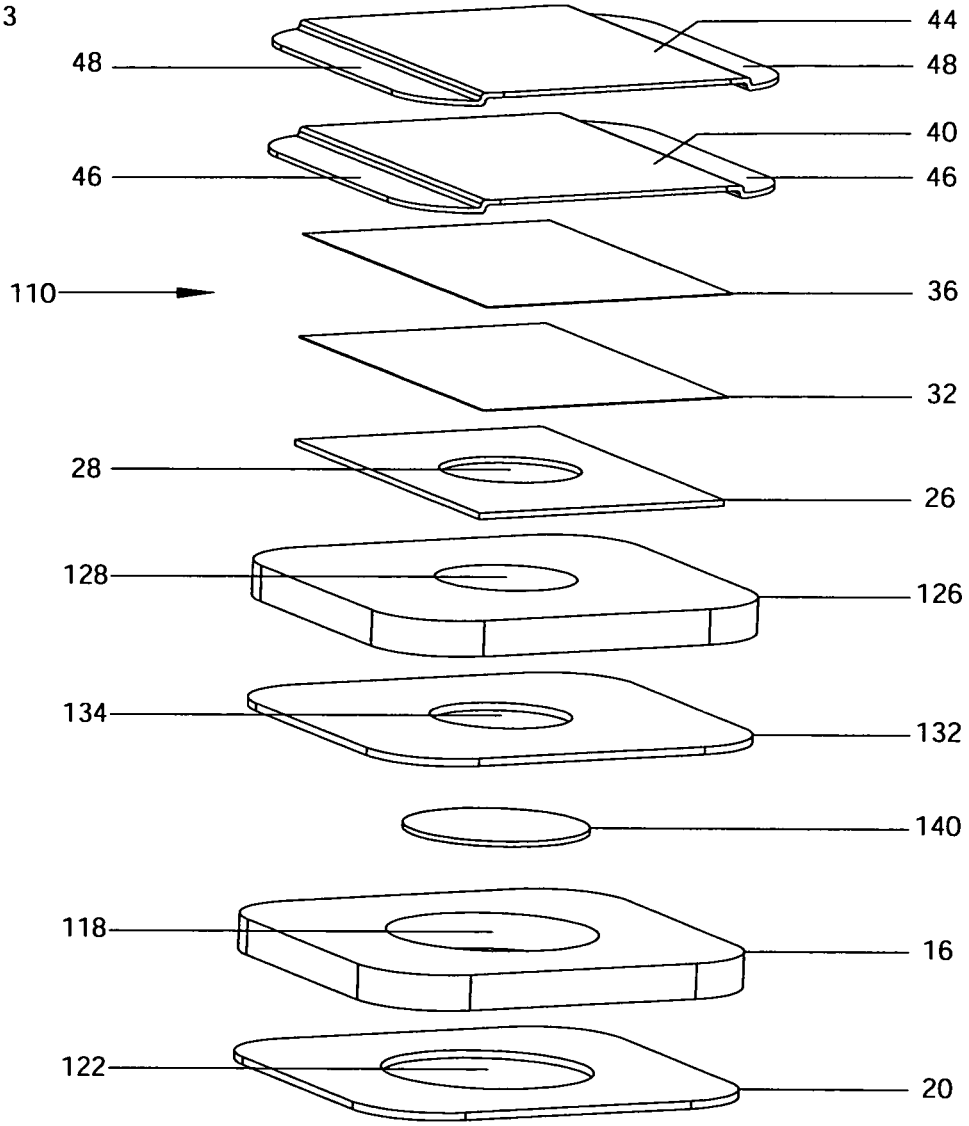
FIG. 3 is an exploded perspective view of a filtered pressure relief valve embodiment of the present invention.

A filtered pressure relief valve 110 embodiment of the present invention is illustrated in FIG. 3. Filtered pressure relief valve 110 may also be mounted on a liner 12 for removal and attachment to product packaging as illustrated in FIG. 1 for pressure relief valve 10. Portions of valve 110 that are the same as pressure relief valve 10 are identified by the same reference numerals. Accordingly, as illustrated in the exploded perspective view of FIG. 3, pressure relief valve 110, has a bottom layer or base membrane 16 and to mount base membrane 16 on liner 12 for later removal from the liner 12 and attachment to packaging, an adhesive layer 20 is applied. A hole or opening 118, as illustrated in FIG. 3, is circular and generally centrally disposed within the perimeter of base membrane 16 and extends through the thickness of base membrane 16. Adhesive layer 20 is also provided with a circular hole or opening 122 conveniently aligned with opening 118 in base membrane 16. Both openings 118 and 122 are larger in diameter than openings 18 and 22 of pressure relief valve 10.

Valve 110 has a gas impervious intermediate layer or membrane 126, similar to base membrane 16, which may also be of polyethylene terephthalate ("PET") or other suitable plastic, approximately 0.25 to 50 mils in thickness. A hole or opening 128, as illustrated in FIG. 3, is generally centrally disposed within the perimeter of intermediate membrane 126 and extends through the thickness of intermediate membrane 126. To affix intermediate membrane 126 to base membrane 16 a layer of adhesive 132 of approximately 0.25 to 15 mils in thickness is applied. Adhesive layer 132 is also provided with a hole or opening 134. Both openings 128 and 134, illustrated as circular openings in FIG. 3, are conveniently generally aligned with each other and conveniently generally concentric with opening 118 in base membrane 16 and opening 122 in adhesive layer 20. The diameter of each of openings 128 and 134 is smaller than the diameter of openings 118 and 122.

A generally circular filter membrane 140 is mounted between base membrane 16 and adhesive layer 132. Filter membrane 140 has a diameter larger than the diameter of openings 128 and 134, but smaller than the diameter of openings 118 and 122. Accordingly filter membrane 140 is secured around its periphery by the underside of adhesive layer 132 beneath intermediate membrane 126, and is recessed in opening 118 of base membrane 16.

Filter membrane 140 may be made of a filter material appropriate for the packaging application in regards to gas flow and the restriction of particulates. For example, for some coffee products, a 10 gsm filter material may be used. The filter material may be a synthetic fabric, more particularly a woven nylon material. One example of a suitable material is Cerex nylon woven material made by Cerex Advanced Fabrics LP, of Cantonment, Fla., which is a particularly durable and tough material. This material has a high resistance to chemical attack, and is resistant to insect and bacterial attack and from mildew. Such a filter material prevents the entrance of fine particulate product like finely ground coffee from further entering the pressure relief valve and disrupting its proper functioning.

Positioned atop intermediate membrane 126, covering opening 128, is a layer 26 of an adhesive-like material. As illustrated in FIG. 3, hole or opening 28 extending through the adhesive-like material layer 26 is also circular of the same general diameter as openings 128 and 124, and conveniently generally aligned with openings 128 and 134. On top of the layer of adhesive-like material layer 26 is dry release film layer 32 coating PET or other plastic membrane 36. The release coated membrane covers openings 28, 128, 134, 118, and 122, with dry release film 32 in contact with adhesive-like material layer 26 creating a surface attraction between dry release film 32 and layer 26. There should not be any sideways leakage, particularly of air into the packaging. None of the layers below adhesive-like material layer 26 should flex away to allow air into the packaging; this is achieved by selection of appropriate materials and thicknesses of each of the layers to fit the packaging of the application.

As in pressure relief valve 10, and as illustrated in FIG. 3, each of layers 26, 32 and 36, extends generally the length of valve 110, but is narrower than the width of valve 110, and the release coated membrane is preferably narrower than the adhesive-like material layer 26. Over the top of membrane 36 and the side edges of the top surface of intermediate membrane 126 is a pressure sensitive adhesive layer 40, with shoulders 46, which secures PET or other plastic membrane 44, with shoulders 48, covering pressure sensitive adhesive layer 40.

Openings 28, 118, 122, 128, and 134 are described and illustrated in this embodiment as circular. However, they may have a different configuration, such as oval.

Valve 110 operates similarly to pressure relief valve 10, with the additional function of blocking the passage of small particles of product such as ground coffee into the valve above base membrane 16.

Figure 4:
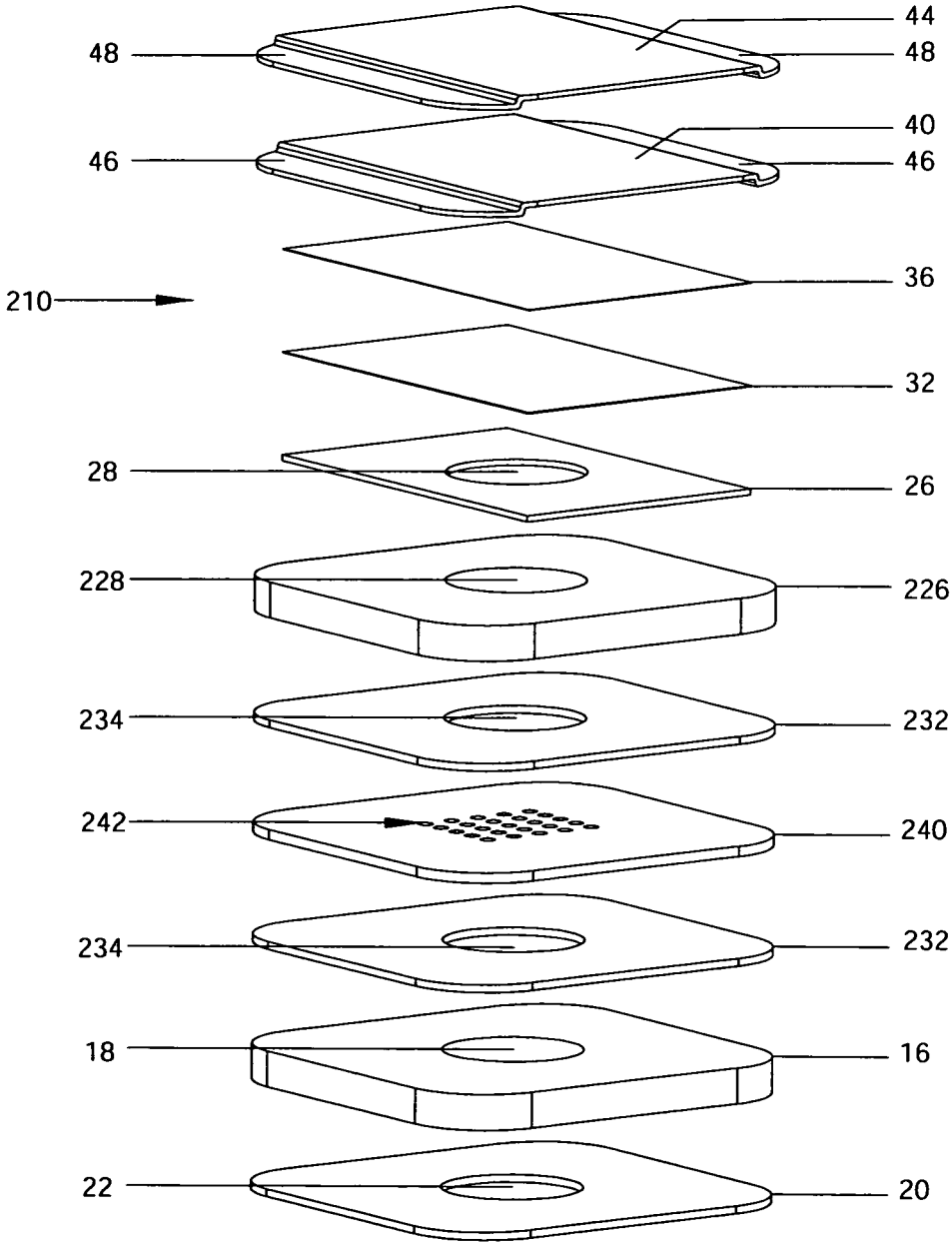
FIG. 4 is an exploded perspective view of another embodiment of a pressure relief valve embodying the present invention with a membrane in between the base layer and a lower base layer that prevents particulates, or in another variation liquid, from entering or penetrating the valve.

Additional embodiments of the present invention are illustrated in FIG. 4. A pressure relief valve 210 of this embodiment may also be mounted on a liner 12 for removal and attachment of valve 210 to product packaging as illustrated in FIG. 1 for pressure relief valve 10. Portions of valve 210 that are the same as pressure relief valve 10 are identified by the same reference numerals. Accordingly, as illustrated in the exploded perspective view of FIG. 4, pressure relief valve 210, has a bottom layer or base membrane 16 with a hole or opening 18 generally centrally disposed within the perimeter of base membrane 16 and extending through the thickness of base membrane 16. To mount base membrane 16 on liner 12 for later removal from the liner 12 and attachment to packaging, an adhesive layer 20 is applied. Adhesive layer 20 is also provided with a hole or opening 22 conveniently aligned with opening 18 in base membrane 16.

Pressure relief valve 210 has a gas impervious intermediate layer or membrane 226, similar to base membrane 16, which may, as an example, also be of polyethylene terephthalate ("PET") or other suitable plastic, approximately 0.25 to 50 mils in thickness. A hole or opening 228, as illustrated in FIG. 3, is generally centrally disposed within the perimeter of intermediate membrane 226 and extends through the thickness of intermediate membrane 226. Between intermediate membrane 226 and base membrane 16 are two spaced apart gas impervious layers of adhesive 232 of approximately 0.25 to 15 mils in thickness. Each adhesive layer 232 is provided with a hole or opening 234. As illustrated in FIG. 4, openings 18, 22, 28, 228 and 234 are circular and conveniently generally aligned with each other.

A filter membrane 240, which may be coextensive with base membrane 16, intermediate membrane 226, and adhesive layers 232, is mounted between base membrane 16 and intermediate membrane 226, more particularly between adhesive layers 232. In one variation, filter membrane 240, may be made of a material such as polyethylene, polyester, or polypropylene, provided with a plurality of laser drilled or punched holes 242, in the area of openings 234, 228, 28, 18 and 22, of a number and size appropriate for the packaging application in regards to gas flow and the restriction of particulates.

In another variation, filter membrane 240 may, without holes 242, be impervious to liquid while allowing the escape of unwanted gases from the packaging. Such a filter material could be an expanded polytetrafluoroethelene (ePTFE) liquid proof breathable fabric or some other hydrophobic or oleophobic material that prevents the passage of an undesirable liquid out of or into the packaging, and accordingly prevents disrupting proper functioning of the pressure relief valve.

Positioned atop intermediate membrane 226, covering opening 228, is layer 26 of adhesive-like material with hole or opening 28 extending through adhesive-like material layer 26. On top of the layer of adhesive-like material layer 26 is dry release film layer 32 coating PET or other plastic membrane 36. The release film layer 32 coated membrane 36 covers openings 28, 228, 234, 18, and 22, with silicone release film layer 32 in contact with adhesive-like material layer 26 creating a surface attraction between release film layer 32 and adhesive-like material layer 26. As in pressure relief valve 10 and as illustrated in FIG. 4, each of layers 26, 32 and 36, extends generally the length of valve 110, but is narrower than the width of valve 210, and the release film layer 32 coated membrane 36 is preferably narrower than the adhesive-like material layer 26.

Over the top of membrane 36 and the side edges of the top surface of intermediate membrane 226 is a pressure sensitive adhesive layer 40 which secures PET or other plastic membrane 44, with shoulders 48, covering pressure sensitive adhesive layer 40.

Openings 18, 22, 28, 228, and 234 are described and illustrated in this embodiment as circular. However, they may have a different configuration, such as oval.

Valve 210 is similar in operation to pressure relief valve 10, with the additional function of blocking the passage of particulates or liquid, depending on the material of filter membrane 240.

The drawings show pressure relief valves of a particular configuration, and particular materials have been described for purposes of illustration. This invention is not limited to these or any other particular configurations or materials. For example, the pressure relief valve of the present invention may be circular, it may have parts of metal foil instead of plastic, and while illustrated as not having rails or ribs, may have rails or ribs.

Solely as an example, the present invention has been discussed in the context of coffee packaging although it can be readily used for the packing of other food and non-consumable products. While a particular embodiment of the invention has been shown and described with some variations, other alternatives, variations and modifications will occur to those skilled in the art. It is intended in the appended claims to cover all such alternatives, variations and modifications that come within the true spirit and scope of the present invention.

What is claimed as new and desired to be secured by Letters Patent is:

1. A self contained one-way pressure relief valve for application over an opening to product packaging, that does not require the addition of a sealing lubricant, comprising:

a gas impervious base layer having a top and bottom;

an opening extending through the base layer from top to bottom;

a gas impervious adhesive-like material layer atop the base layer around the opening extending through the base layer;

a gas impervious release film coated membrane; and the release film coated membrane covering the opening extending through the base layer with the release film in contact with the adhesive-like material creating a surface attraction between the release film and the adhesive-like material until the release film and the adhesive-like material are separated from each other by pressure from within the product packaging.

2. The self contained one-way pressure relief valve of claim 1 in which the release film coated membrane covering the opening extending through the base layer does not extend to the edges of the adhesive-like material layer in one direction.

3. The self contained one-way pressure relief valve of claim 2 in which the release film coated membrane covering the opening extending through the base layer does not extend to the edges of the base layer in one direction.

4. The self contained one-way pressure relief valve of claim 1 further comprising:

a gas impervious adhesive layer having a thickness on the bottom of the base layer for attaching the base layer to the packaging; and an opening, generally aligned with the opening extending through the base layer, extending through the thickness of the adhesive layer.

5. The self contained one-way pressure relief valve of claim 1 further comprising:

a gas impervious cover layer; and a gas impervious adhesive layer between the cover layer and the release film coated membrane, opposite the release film.

6. The self contained one-way pressure relief valve of claim 5 in which the release film coated membrane covering the opening extending through the base layer does not extend to the edges of the adhesive-like material layer in one direction.

7. The self contained one-way pressure relief valve of claim 5 in which the release film coated membrane covering the opening extending through the base layer does not extend to the edges of the base layer in one direction.

8. The self contained one-way pressure relief valve of claim 1 further comprising:

a gas impervious intermediate layer having a top and bottom between the adhesive-like material layer and the base layer;

an opening extending through the intermediate layer from top to bottom and generally aligned with the opening in the base layer and the opening in the adhesive-like material layer;

a filter material layer between the openings of the intermediate layer and the base layer;

a gas impervious layer of adhesive between the intermediate layer and the filter material layer; and an opening extending through the layer of adhesive between the intermediate layer and the filter material layer, and generally aligned with the openings of the adhesive-like material layer, the intermediate layer, and the base layer.

9. The self contained one-way pressure relief valve of claim 8 in which:

the opening in the base layer is larger than the openings in the intermediate layer and the layer of adhesive between the intermediate layer and the filter material layer;

the filter material layer is secured around its periphery by a portion of the layer of adhesive between the intermediate layer and the filter material layer; and the filter material layer is recessed in the opening in the base layer.

10. The self contained one-way pressure relief valve of claim 8 in which the filter material layer includes a plurality of openings of a size to prevent the passage of the product into the opening of the intermediate layer.

11. The self contained one-way pressure relief valve of claim 8 including:

a gas impervious layer of adhesive between the filter material layer and the base layer; and an opening extending through the layer of adhesive between the filter material layer and the base layer, and generally aligned with the openings of the adhesive-like material layer, the intermediate layer, the layer of adhesive between the intermediate layer and the filter material layer, and the base layer.

12. The self contained one-way pressure relief valve of claim 11 in which the filter material layer includes a plurality of openings of a size to prevent the passage of the product into the opening of the intermediate layer in the area of the generally aligned openings extending through the adhesive-like material layer, the intermediate layer, the layer of adhesive between the intermediate layer and the filter material layer, the layer of adhesive between the filter material layer and the base layer, and the base layer.

13. The self contained one-way pressure relief valve of claim 10 in which the filter material layer prevents the passage of liquid while permitting the escape of gas.

14. The self contained one-way pressure relief valve of claim 13 in which the filter material layer is an expanded polytetrafluoroethylene material.

15. The self contained one-way pressure relief valve of claim 13 in which the filter material layer is a liquid proof breathable fabric.

16. The self contained one-way pressure relief valve of claim 13 in which the filter material layer is a hydrophobic material.

17. The self contained one-way pressure relief valve of claim 13 in which the filter material layer is an oleophobic material.

18. A self contained one-way pressure relief valve for application over an opening in an exterior surface of packaging containing a gas producing product, the valve comprising:

a gas impervious base layer having a top and a bottom;

a gas inlet opening extending through the base layer from the top to the bottom of the base layer;

a layer of adhesive on the bottom of the base layer around the gas inlet opening for attachment of the pressure relief valve to the exterior surface of the packaging;

a gas impervious topmost layer spaced above the base layer and overlying the gas inlet opening extending through the base layer;

a gas impervious intermediate layer having a top and a bottom and being between the topmost layer and the base layer;

a gas flow opening extending through the intermediate layer from the intermediate layer bottom to the intermediate layer top, the intermediate layer gas flow opening being generally aligned with the base layer gas inlet opening;

a one-way valve element between the intermediate layer and the topmost layer providing one-way gas flow from within the packaging through the opening in the surface of the packaging, the gas inlet opening, the gas flow opening, and out of the valve;

a filter material layer between the intermediate layer gas flow opening and the base layer gas inlet opening;

a gas impervious layer of adhesive between the intermediate layer and the filter material layer; and an opening extending through the layer of adhesive between the intermediate layer and the filter material layer, and generally aligned with the intermediate layer gas flow opening and the base layer gas inlet opening.

19. The self contained one-way pressure relief valve of claim 18 in which:

the gas inlet opening in the base layer is larger than the gas flow openings in the intermediate layer;

the filter material layer is secured around its periphery by a portion of the layer of adhesive between the intermediate layer and the filter material layer; and the filter material layer, secured by the adhesive layer above the base layer, is recessed in the opening in the base layer.

20. The self contained one-way pressure relief valve of claim 18 in which the filter material layer includes a plurality of openings of a size to prevent the passage of the product into the opening of the intermediate layer.

21. The self contained one-way pressure relief valve of claim 18 including:

a gas impervious layer of adhesive between the filter material layer and the base layer; and an opening extending through the layer of adhesive between the filter material layer and the base layer, and generally aligned with the openings of the intermediate layer, the layer of adhesive between the intermediate layer and the filter material layer, and the base layer.

22. The self contained one-way pressure relief valve of claim 21 in which the filter material layer includes a plurality of openings of a size to prevent the passage of the product into the opening of the intermediate layer in the area of the generally aligned openings extending through the intermediate layer, the layer of adhesive between the intermediate layer and the filter material layer, the layer of adhesive between the filter material layer and the base layer, and the base layer.

23. The self contained one-way pressure relief valve of claim 20 in which the filter material layer prevents the passage of liquid while permitting the escape of gas.

24. A self contained one-way pressure relief valve for application over an opening in product packaging containing a gas-producing substance, the valve comprising:

a gas-impervious base layer having a bottom side for attachment to the packaging and a top side;

an opening extending entirely through the base layer;

a gas impervious adhesive-like material layer on the base layer top side around the base layer opening; and a gas-impervious release-film-coated membrane covering the base layer opening and being attracted to, and overlying, the adhesive-like material layer to block gas flow through the base layer opening and between the membrane and the adhesive-like material layer, the attraction being such that the membrane is at least partially separable from the adhesive-like material layer by pressure from within the packaging to permit one-way gas flow out of the package and valve through the base layer opening and between the membrane and adhesive-like material layer.

25. A self contained one-way pressure relief valve for application over an opening in product packaging containing a gas-producing substance, the valve comprising:

a gas-impervious base layer having a bottom side for attachment to the packaging and a top side;

an opening extending entirely through the base layer;

a gas impervious adhesive-like material layer on the base layer top side around the base layer opening; and a gas-impervious release-film-coated membrane of a material having an attraction with the adhesive-like material layer, the membrane covering the base layer opening and overlying the adhesive-like material layer to block gas flow through the base layer opening and between the membrane and the adhesive-like material layer, the attraction being such that the membrane is held against the adhesive-like material layer until pressure from within the packaging against the membrane overcomes the attraction and at least partially separates the membrane from the adhesive-like material layer to permit one-way gas flow out of the packaging and valve through the base layer opening and between the membrane and adhesive-like material layer.

* * * * *